US007500376B2

(12) United States Patent
Bathurst et al.

(10) Patent No.: US 7,500,376 B2
(45) Date of Patent: Mar. 10, 2009

(54) METHOD AND APPARATUS FOR SHAPING A METALLIC CONTAINER END CLOSURE

(75) Inventors: Jess N. Bathurst, Fort Collins, CO (US); James D. Traphagen, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 11/192,978

(22) Filed: Jul. 29, 2005

(65) Prior Publication Data

US 2006/0042344 A1 Mar. 2, 2006

Related U.S. Application Data

(60) Provisional application No. 60/592,784, filed on Jul. 29, 2004.

(51) Int. Cl.
*B21D 22/00* (2006.01)

(52) U.S. Cl. ..... 72/348; 72/379.4; 413/8; 413/56

(58) Field of Classification Search ..... 72/348, 72/379.4; 413/8, 56
See application file for complete search history.

(56) References Cited

U.S. PATENT DOCUMENTS

| | | | |
|---|---|---|---|
| 91,754 | A | 6/1869 | Lawernce |
| 163,747 | A | 5/1875 | Cummings |
| 706,296 | A | 8/1902 | Bradley |
| 766,604 | A | 8/1904 | Dilg |
| 801,683 | A | 10/1905 | Penfold |
| 818,438 | A | 4/1906 | Heindorf |
| 868,916 | A | 10/1907 | Dieckmann |
| 1,045,055 | A | 11/1912 | Mittinger, Jr. |
| 2,318,603 | A | 5/1943 | Erb |
| D141,415 | S | 5/1945 | Wargel et al. |
| 2,759,628 | A | 8/1956 | Sokoloff |
| 2,894,844 | A | 7/1959 | Shakman |
| 3,023,927 | A | 3/1962 | Ehman |
| 3,105,765 | A | 10/1963 | Creegan |
| 3,176,872 | A | 4/1965 | Zundel |
| 3,208,627 | A | 9/1965 | Lipske |
| 3,251,515 | A | 5/1966 | Henchert et al. |
| 3,268,105 | A | 8/1966 | Geiger |

(Continued)

FOREIGN PATENT DOCUMENTS

| | | |
|---|---|---|
| CH | 327383 | 3/1958 |

(Continued)

OTHER PUBLICATIONS

Brewing Industry Recommended Can Specifications Manual, United States Brewers Assoc., Inc. 1983.

(Continued)

*Primary Examiner*—Derris H Banks
*Assistant Examiner*—Debra M Wolfe
(74) *Attorney, Agent, or Firm*—Sheridan Ross P.C.

(57) ABSTRACT

The present invention describes an apparatus and forming process to manufacture container end closures with improved internal buckle strength. The present invention provides greater material and dimensional control during the forming process by utilizing a pressure sleeve to provide support to at least a portion of an end closure chuck wall and seaming panel radius while placing an end closure countersink in compression during the forming process.

26 Claims, 23 Drawing Sheets

Free and Compression Forming
Single Action

U.S. PATENT DOCUMENTS

| | | | | |
|---|---|---|---|---|
| D206,500 | S | | 12/1966 | Nissen et al. |
| 3,397,811 | A | | 8/1968 | Lipske |
| 3,417,898 | A | | 12/1968 | Bozek et al. |
| 3,480,175 | A | | 11/1969 | Khoury |
| 3,564,895 | A | | 2/1971 | Pfanner et al. |
| 3,650,387 | A | | 3/1972 | Hornsby et al. |
| 3,734,338 | A | | 5/1973 | Schubert |
| 3,744,667 | A | | 7/1973 | Fraze et al. |
| D229,396 | S | | 11/1973 | Zundel |
| 3,774,801 | A | | 11/1973 | Gedde |
| 3,814,279 | A | | 6/1974 | Rayzal |
| 3,836,038 | A | | 9/1974 | Cudzik |
| 3,843,014 | A | | 10/1974 | Cospen et al. |
| 3,874,553 | A | | 4/1975 | Schultz et al. |
| 3,904,069 | A | | 9/1975 | Toukmanian |
| 3,967,752 | A | | 7/1976 | Cudzik |
| 3,982,657 | A | | 9/1976 | Keller et al. |
| 3,983,827 | A | | 10/1976 | Meadors |
| 4,015,744 | A | | 4/1977 | Brown |
| 4,024,981 | A | | 5/1977 | Brown |
| 4,030,631 | A | | 6/1977 | Brown |
| 4,031,837 | A | | 6/1977 | Jordan |
| 4,037,550 | A | | 7/1977 | Zofko |
| 4,043,168 | A | | 8/1977 | Mazurek |
| 4,093,102 | A | | 6/1978 | Kraska |
| 4,109,599 | A | | 8/1978 | Schultz |
| 4,127,212 | A | | 11/1978 | Waterbury |
| 4,148,410 | A | | 4/1979 | Brown |
| 4,150,765 | A | | 4/1979 | Mazurek |
| 4,210,257 | A | | 7/1980 | Radtke |
| 4,213,324 | A | | 7/1980 | Kelley et al. |
| 4,215,795 | A | | 8/1980 | Elser |
| 4,217,843 | A | | 8/1980 | Kraska |
| 4,271,778 | A | | 6/1981 | Le Bret |
| 4,276,993 | A | | 7/1981 | Hasegawa |
| 4,286,728 | A | | 9/1981 | Fraze et al. |
| 4,341,321 | A | | 7/1982 | Gombas |
| 4,365,499 | A | | 12/1982 | Hirota et al. |
| 4,387,827 | A | | 6/1983 | Ruemer, Jr. |
| 4,402,419 | A | | 9/1983 | MacPherson |
| 4,420,283 | A | | 12/1983 | Post |
| 4,434,641 | A | | 3/1984 | Nguyen |
| 4,448,322 | A | | 5/1984 | Kraska |
| 4,467,933 | A | | 8/1984 | Wilkinson et al. |
| D279,265 | S | | 6/1985 | Turner et al. |
| 4,530,631 | A | | 7/1985 | Kaminski et al. |
| D281,581 | S | | 12/1985 | MacEwen |
| 4,559,801 | A | | 12/1985 | Smith et al. |
| 4,571,978 | A | * | 2/1986 | Taube et al. ..... 72/349 |
| 4,578,007 | A | | 3/1986 | Diekhoff |
| 4,606,472 | A | | 8/1986 | Taube et al. |
| D285,661 | S | | 9/1986 | Brownbill |
| 4,641,761 | A | | 2/1987 | Smith et al. |
| 4,674,649 | A | | 6/1987 | Pavely |
| 4,681,238 | A | | 7/1987 | Sanchez |
| 4,685,582 | A | | 8/1987 | Pulciani et al. |
| 4,704,887 | A | | 11/1987 | Bachmann et al. |
| 4,713,958 | A | | 12/1987 | Bulso, Jr. et al. |
| 4,715,208 | A | | 12/1987 | Bulso, Jr. et al. |
| 4,716,755 | A | * | 1/1988 | Bulso et al. ..... 72/349 |
| 4,722,215 | A | | 2/1988 | Taube et al. |
| 4,735,863 | A | | 4/1988 | Bachmann et al. |
| 4,790,705 | A | | 12/1988 | Wilkinson et al. |
| 4,808,052 | A | | 2/1989 | Bulso, Jr. et al. |
| 4,809,861 | A | | 3/1989 | Wilkinson |
| D300,607 | S | | 4/1989 | Ball |
| D300,608 | S | | 4/1989 | Taylor et al. |
| 4,823,973 | A | | 4/1989 | Jewitt et al. |
| 4,832,236 | A | | 5/1989 | Greaves |
| 4,865,506 | A | | 9/1989 | Kaminski |
| D304,302 | S | | 10/1989 | Dalli et al. |
| 4,890,759 | A | | 1/1990 | Scanga et al. |
| 4,893,725 | A | | 1/1990 | Ball et al. |
| 4,895,012 | A | | 1/1990 | Cook et al. |
| 4,919,294 | A | | 4/1990 | Kawamoto |
| RE33,217 | E | | 5/1990 | Nguyen |
| 4,930,658 | A | | 6/1990 | McEldowney |
| 4,934,168 | A | | 6/1990 | Osmanski et al. |
| 4,955,223 | A | | 9/1990 | Stodd et al. |
| 4,967,538 | A | | 11/1990 | Leftault, Jr. et al. |
| 4,991,735 | A | | 2/1991 | Biondich |
| 4,994,009 | A | | 2/1991 | McEldowney |
| 5,027,580 | A | | 7/1991 | Hymes et al. |
| 5,042,284 | A | | 8/1991 | Stodd et al. |
| 5,046,637 | A | | 9/1991 | Kysh |
| 5,064,087 | A | | 11/1991 | Koch |
| 5,066,184 | A | | 11/1991 | Taura et al. |
| 5,129,541 | A | | 7/1992 | Voigt et al. |
| 5,143,504 | A | | 9/1992 | Braakman |
| 5,145,086 | A | | 9/1992 | Krause |
| 5,149,238 | A | | 9/1992 | McEldowney et al. |
| D337,521 | S | | 7/1993 | McNulty |
| 5,289,938 | A | | 3/1994 | Sanchez |
| D347,172 | S | | 5/1994 | Heynan et al. |
| 5,309,749 | A | | 5/1994 | Stodd |
| 5,320,469 | A | | 6/1994 | Katou et al. |
| 5,356,256 | A | | 10/1994 | Turner et al. |
| D352,898 | S | | 11/1994 | Vacher |
| 5,381,683 | A | | 1/1995 | Cowling |
| D356,498 | S | | 3/1995 | Strawser |
| 5,494,184 | A | | 2/1996 | Noguchi et al. |
| 5,502,995 | A | | 4/1996 | Stodd |
| 5,527,143 | A | | 6/1996 | Turner et al. |
| 5,582,319 | A | | 12/1996 | Heyes et al. |
| 5,590,807 | A | | 1/1997 | Forrest et al. |
| 5,598,734 | A | | 2/1997 | Fortest et al. |
| 5,634,366 | A | | 6/1997 | Stodd |
| 5,636,761 | A | | 6/1997 | Diamond et al. |
| 5,653,355 | A | | 8/1997 | Tominaga et al. |
| 5,685,189 | A | * | 11/1997 | Nguyen et al. ..... 72/348 |
| 5,829,623 | A | | 11/1998 | Otsuka et al. |
| 5,857,374 | A | | 1/1999 | Stodd |
| D406,236 | S | | 3/1999 | Brifcani et al. |
| 5,911,551 | A | | 6/1999 | Moran |
| 5,950,858 | A | | 9/1999 | Sergeant |
| 5,969,605 | A | | 10/1999 | McIntyre et al. |
| 6,065,634 | A | | 5/2000 | Brifcani et al. |
| 6,089,072 | A | | 7/2000 | Fields |
| 6,102,243 | A | | 8/2000 | Fields et al. |
| 6,126,034 | A | | 10/2000 | Borden et al. |
| 6,131,761 | A | | 10/2000 | Cheng et al. |
| D452,155 | S | | 12/2001 | Stodd |
| 6,419,110 | B1 | | 7/2002 | Stodd |
| 6,460,723 | B2 | | 10/2002 | Nguyen et al. |
| 6,499,622 | B1 | | 12/2002 | Neiner |
| 6,516,968 | B2 | | 2/2003 | Stodd |
| 6,526,799 | B2 | | 3/2003 | Ferraro et al. |
| 6,561,004 | B1 | | 5/2003 | Neiner et al. |
| 6,658,911 | B2 | | 12/2003 | McClung |
| 6,702,142 | B2 | | 3/2004 | Neiner |
| 6,748,789 | B2 | | 6/2004 | Turner et al. |
| 6,848,875 | B2 | | 2/2005 | Brifcani et al. |
| 6,877,941 | B2 | | 4/2005 | Brifcani et al. |
| 6,935,826 | B2 | | 8/2005 | Brifcani et al. |
| 6,968,724 | B2 | * | 11/2005 | Hubball ..... 72/348 |
| 7,100,789 | B2 | | 9/2006 | Nguyen et al. |
| 2003/0198538 | A1 | | 10/2003 | Brifcani et al. |
| 2004/0026433 | A1 | | 2/2004 | Brifcani et al. |
| 2004/0026434 | A1 | | 2/2004 | Brifcani et al. |
| 2004/0140312 | A1 | | 7/2004 | Neiner |
| 2004/0238546 | A1 | | 12/2004 | Watson et al. |
| 2005/0006395 | A1 | | 1/2005 | Reed et al. |
| 2005/0115976 | A1 | | 6/2005 | Watson et al. |
| 2005/0247717 | A1 | | 11/2005 | Brifcani et al. |

| | | | |
|---|---|---|---|
| 2005/0252922 | A1 | 11/2005 | Reed et al. |
| 2006/0010957 | A1 | 1/2006 | Hubball |

FOREIGN PATENT DOCUMENTS

| | | |
|---|---|---|
| DE | 734942 | 5/1943 |
| DE | G 92 11 788 | 2/1993 |
| EP | 0139282 | 5/1985 |
| EP | 0340955 | 11/1989 |
| EP | 153115 | 5/1990 |
| EP | 0828663 | 3/1998 |
| EP | 828663 | 12/1999 |
| EP | 1361164 | 11/2003 |
| GB | 2196891 | 5/1988 |
| GB | 2218024 | 11/1989 |
| GB | 2315478 | 11/1996 |
| GB | 9834743 | 8/1998 |
| JP | 49-096887 | 9/1974 |
| JP | 50-144580 | 11/1975 |
| JP | 54-074184 | 6/1979 |
| JP | 55-122945 | 2/1980 |
| JP | S57-117323 | 1/1981 |
| JP | 56-053835 | 5/1981 |
| JP | 56-053836 | 5/1981 |
| JP | 57-044435 | 3/1982 |
| JP | 57-094436 | 6/1982 |
| JP | 58-035028 | 3/1983 |
| JP | 58-035029 | 3/1983 |
| JP | 59-144535 | 8/1984 |
| JP | 61-023533 | 2/1986 |
| JP | 63-125152 | 5/1988 |
| JP | 1167050 | 6/1989 |
| JP | 01-170538 | 7/1989 |
| JP | 01-289526 | 11/1989 |
| JP | 02-092426 | 4/1990 |
| JP | 2192837 | 7/1990 |
| JP | 02-131931 | 11/1990 |
| JP | 03-032835 | 2/1991 |
| JP | 3275443 | 12/1991 |
| JP | 04-033733 | 2/1992 |
| JP | 532255 | 2/1993 |
| JP | H5-112357 | 5/1993 |
| JP | 5 185170 | 7/1993 |
| JP | 6127547 | 5/1994 |
| JP | 07-171645 | 7/1995 |
| JP | 08-168837 | 7/1996 |
| JP | 08-192840 | 7/1996 |
| JP | 2000-109068 | 4/2000 |
| WO | 8910216 | 11/1989 |
| WO | 9317864 | 9/1993 |
| WO | 9637414 | 11/1996 |
| WO | 0012243 | 3/2000 |
| WO | WO 01/41948 | 6/2001 |
| WO | WO 02/43895 | 6/2002 |
| WO | WO 03/059764 | 7/2003 |
| WO | 05032953 | 4/2005 |

OTHER PUBLICATIONS

Beverage Can, End, & Double Seam Dimensional Specifications, Society of Soft Drink Technologists, Aug. 1993.

U.S. Appl. No. 09/552,668, filed Apr. 19, 2000, Brifcani.

U.S. Appl. No. 09/650,664, filed Aug. 30, 2000, Brifcani.

International Search Report for International (PCT) Patent Application No. PCT/US2005/026896, mailed Aug. 23, 2006.

Written Opinion for International (PCT) Patent Application No. PCT/US2005/026896, mailed Aug. 23, 2006.

International Preliminary Report on Patentability for International (PCT) Patent Application No. PCT/US2005/026896, mailed Feb. 8, 2007.

European Search Report and Opinion for European Patent Application No. 05777356.6, mailed Jul. 7, 2008.

* cited by examiner

Inner Pressure Sleeve
Simplified

Inner Pressure Sleeve
Timing

Free and Compression Forming
Single Action

Inner Pressure Sleeve Features

Inner Pressure Sleeve Form Comparison

Free and Compression Forming

Prior Art Compression Forming

Inner Pressure Sleeve Form Comparison

Free and Compression Forming

Prior Art Compression Forming

Inner Pressure Sleeve Form Comparison

Free and Compression Forming

Prior Art Compression Forming

Inner Pressure Sleeve Form Comparison

Prior Art
Compression Forming

Free and
Compression Forming

Inner Pressure Sleeve Form Comparison

Free and Compression Forming

Prior Art Compression Forming

Bottom Dead Center

Inner Pressure Sleeve Form Comparison

Free and Compression Forming

Prior Art Compression Forming

Prior Art Free Forming Countersink

Inner Pressure Sleeve Form Comparison

Prior Art
Compression Forming

Free and
Compression Forming

Inner Pressure Sleeve Form Comparison

Free and Compression Forming

Prior Art Compression Forming

Inner Pressure Sleeve Form Comparison

Free and Compression Forming

Prior Art Compression Forming

Inner Pressure Sleeve Form Comparison

Free and Compression Forming

Prior Art Compression Forming

Inner Pressure Sleeve Form Comparison

Free and Compression Forming

Prior Art Compression Forming

METHOD AND APPARATUS FOR SHAPING A METALLIC CONTAINER END CLOSURE

This application claims the benefit of U.S. Provisional Patent Application Ser. No. 60/592,784, filed Jul. 29, 2004, which is incorporated by reference in its entirety herein.

FIELD OF INVENTION

The present invention relates to a manufacturing process for forming metallic containers and container end closures, and more specifically a method and apparatus for forming high strength geometries while maintaining necessary chuck wall and seaming panel characteristics.

BACKGROUND OF INVENTION

Metallic beverage can end closures have historically been designed and manufactured to provide a stiffening bead referred to as countersink. This feature may include vertical walls attached by a full radius bottom forming a channel, and in some embodiments may incorporate arcuate shapes or other geometric profiles. Absolute vertical walls may not exist, but generally the more vertical they become the greater the resistance to deformations resulting from internal pressure.

Beverage can bodies and end closures must be durable to withstand high internal pressures, yet manufactured with extremely thin and durable materials such as aluminum to decrease the overall cost of the manufacturing process and the weight of the finished product. Accordingly, there exists a significant need for a durable beverage can end closure which can withstand the high internal pressures created by carbonated beverages, and the external forces applied during shipping, yet which are made from durable, lightweight and extremely thin metallic materials with geometric configurations which reduce material requirements. To obtain these characteristics, can end closures require aggressive material working to achieve the various forms and geometries, which is generally accomplished utilizing a male/female tool combination. Unfortunately, this process may lead to inconsistencies within a given contour or geometry. Formation inconsistencies also apply to strength performance. The aggressive forming within the countersink may alter other characteristics within the body of the entire structure. Thus, there is a significant need to provide an apparatus and material forming technique which provides improved end closure on container geometries which have improved strength and buckle resistance. These features are obtained in one embodiment by placing the end closure material in compression during forming to avoid thinning and unwanted material deformation, while simultaneously supporting certain portions of the end closure chuck wall and seaming crown geometry during forming while not supporting other portions to create a predetermined shape.

One patent related to a method and apparatus for producing a container end closure countersink is described in U.S. Pat. No. 5,685,189, (the "'189 patent") which is incorporated herein by reference in its entirety. In the '189 patent, a portion of the countersink is formed when the countersink is unsupported by tooling while the countersink is placed in compression. Unfortunately, with lighter gage stock materials this process has been found to allow unwanted deformation in the chuck wall and seaming crown, and thus inconsistencies in the end closure geometry.

SUMMARY OF THE INVENTION

The present invention relates to an apparatus and method for forming a preferred geometric shape in containers and end closures utilizing thin walled materials (0.0084 or less gauge) which have improved strength characteristics and material properties. Thus, in one aspect of the present invention a "free forming" process is used in the manufacturing of a metallic container end closure, wherein at least a portion of the material is placed in compression during forming, and is thus less likely to become "coined" or thinned, and ultimately weakened. It is a further aspect of the present invention to provide a method and apparatus for forming a predetermined shape from a metallic material wherein a portion of the metallic material is unsupported by a tool during formation. Thus, a portion of the metallic material is allowed to "free form" into a desired shape without being substantially supported on both the entire upper or lower surface of the material.

It is a further aspect of the present invention to provide a forming press to form a preferred geometry in a metallic end closure with existing high speed forming processes currently known in the industry and having improved reliability. Thus, in one aspect of the present invention an inner pressure sleeve is utilized in combination with critical forming parameters to assure that the end closure achieves a predetermined geometry, and is extracted efficiently from the forming process at speeds of 1800-11,000 end closures/minute.

It is a further aspect of the present invention to provide an inner pressure sleeve which is driven with pins extending between itself and either a pneumatic piston, spring plate or individual springs to apply a sufficient force to support a portion of an end closure chuck wall to form a preferred geometry during manufacturing.

It is another aspect of the present invention to provide an apparatus and method for forming a preferred geometric shape in container end closures where other portions of the end closure are supported on both an interior and exterior surface to prevent movement and unwanted deformation, while another portion is allowed to "free form". Thus, in one embodiment of the present invention a "pressure sleeve" is used to support an end closure chuck wall and/or the seaming panel radius against a die core ring during forming, while at least a portion of the countersink is placed in compression to form a preferred geometry. Thus, in one aspect of the present invention an apparatus for forming a preferred shape in a metallic blank to create a beverage container end closure with a preferred geometry. It is another aspect of the present invention to provide a method and apparatus for forming improved end closure geometries by generally utilizing tooling equipment which is well known in a container end closure manufacturing plant, and thus requires only minor modifications to implement. Thus, in one embodiment of the invention, an apparatus is provided to form a metallic end closure which generally comprises:

a first tool in opposing relationship to a second tool which is adapted to provide a clamping force on a portion of a seaming panel of the metallic material;

a third tool in opposing relationship to a fourth tool which is adapted to providing a clamping force on a central panel portion of the metallic material;

a fifth tool positioned between said first tool and said third tool, which is adapted to support at least a portion of a chuck wall portion of said metallic material; and providing a reciprocating motion between at least said fifth tool and said first and second tools while a portion of a countersink in the container end closure remains unsupported, wherein a preferred geometry is created in the countersink producing a material thickening, thus avoiding a reduction of material thickness of the countersink.

In another aspect of the present invention, a method for forming a predetermined shape in a metallic container end closure is provided herein, the end closure generally comprising a seaming panel interconnected to a downwardly extending chuckwall, a central panel having a substantially vertical center axis, and a countersink integrally interconnected to a lower portion of the chuck wall and the central panel, comprising:

positioning an end closure blank in a forming press;

providing a clamping force on at least a portion of the seaming panel between a first tool and a second tool;

providing a clamping force on at least a portion of the central panel between a third tool and a fourth tool to substantially prevent movement of the central panel;

supporting at least a portion of the chuckwall on both an interior surface and an exterior surface to substantially prevent movement of at least a portion of the chuckwall;

supporting a first portion of the countersink with at least one of said third tool and said fourth tool while allowing another portion of the countersink to remain unsupported; and providing a compressive force on the countersink while retaining the chuck wall in a preferred position, wherein the end closure is formed into a predetermined shape.

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

| # | Component |
|---|---|
| 1 | Unseamed beverage end closure |
| 2 | Seaming panel |
| 3 | Outer seaming panel radius |
| 4 | Seaming panel radius |
| 5 | Inner seaming panel |
| 6 | Chuck wall |
| 7 | Countersink |
| 8 | Countersink outer panel wall |
| 9 | Countersink inner panel wall lower portion |
| 10 | Countersink inner panel wall |
| 11 | Center panel radius |
| 12 | Center panel |
| 13 | Uncurled seam height |
| 14 | Metallic material |
| 15 | Die construction, shown at the stop position |
| 16 | Blank punch |
| 17 | Cut edge |
| 18 | Draw ring |
| 19 | Die core ring |
| 20 | Panel punch |
| 21 | Countersink punch |
| 22 | Outer pressure sleeve |
| 23 | Re-draw die |
| 24 | Inner pressure sleeve |
| 25 | Inner panel wall lower end |
| 26 | Cup radius |
| 27 | First countersink radius |
| 28 | Second countersink radius |
| 29 | Third countersink radius |
| 30 | Cup bottom |
| 31 | Blank punch face |
| 32 | Blank punch inner diameter |
| 33 | Draw ring face |
| 34 | Die core ring top surface |
| 35 | Die core ring outermost diameter |
| 36 | Die core ring inner wall |
| 37 | Panel punch face |
| 38 | Panel punch outer wall |
| 39 | Panel punch radius |
| 40 | Panel punch core angle |
| 41 | Die core radius |
| 42 | Die core face |
| 43 | Knockout face |

DETAILED DESCRIPTION

Figure 1:
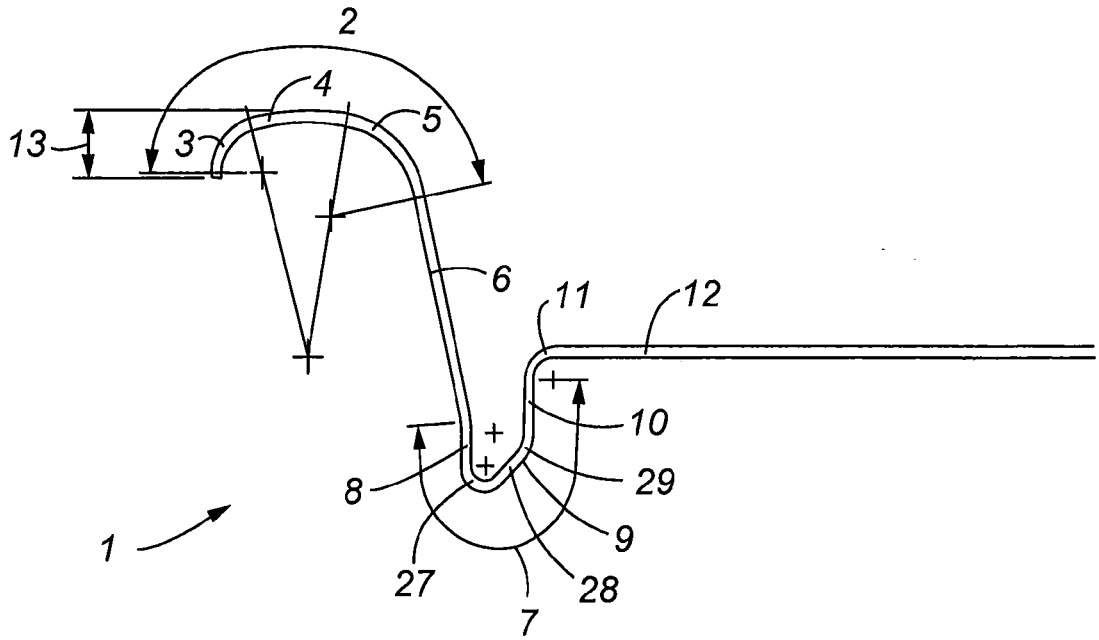
FIG. 1 is a cross-sectional front elevation view of a typical beverage container end closure.
Figure 2:
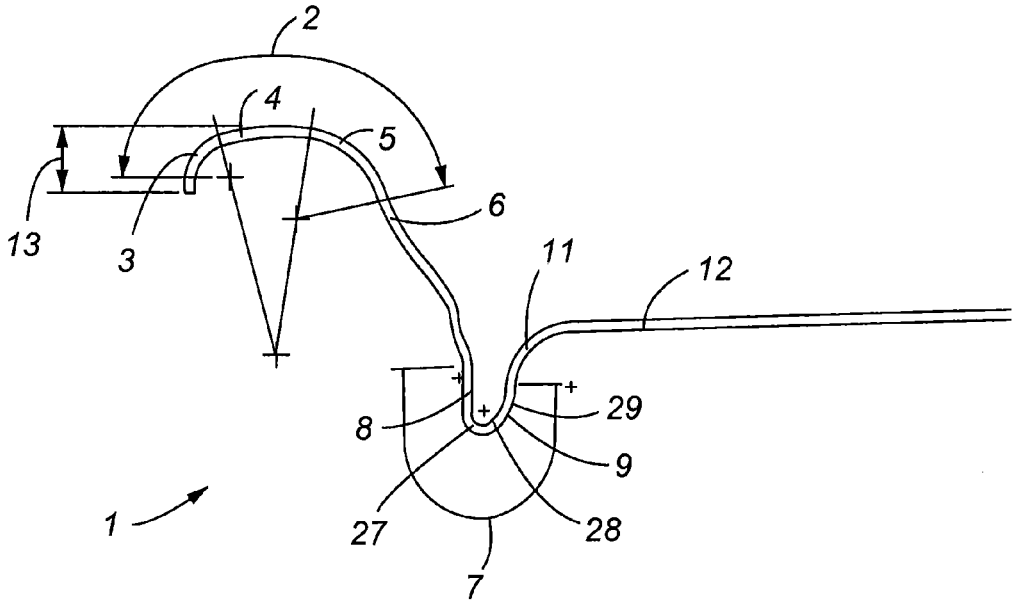
FIG. 2 is a cross-sectional front elevation view of another embodiment of a beverage container end closure.
Figure 3:
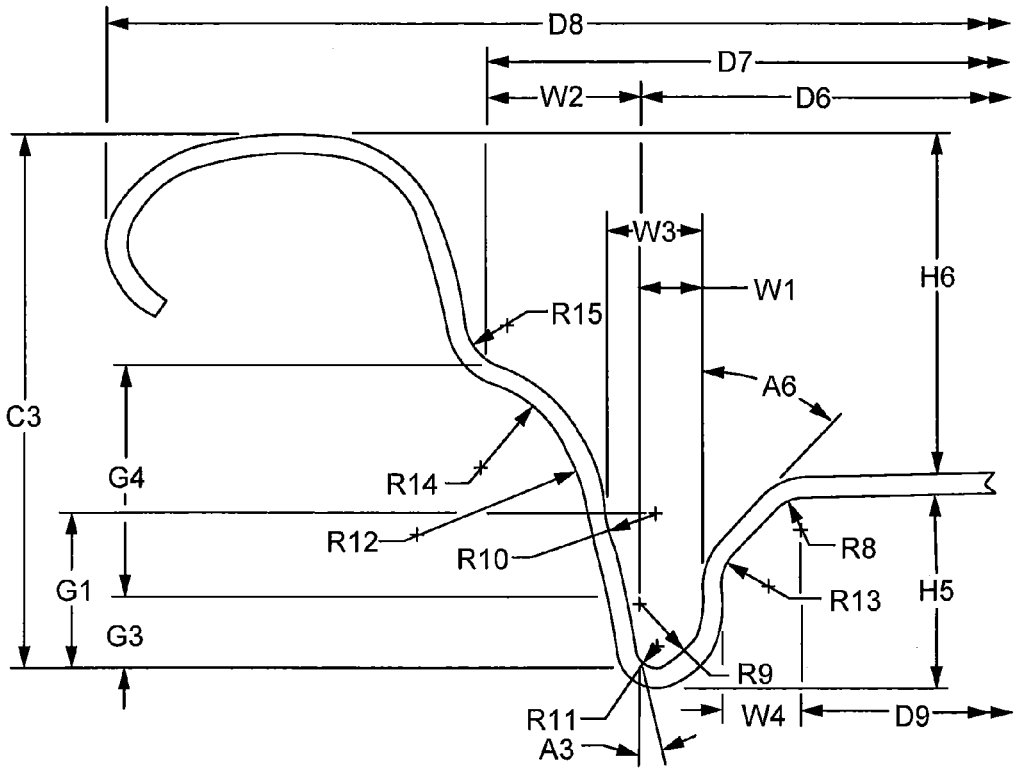
FIG. 3 is a cross-sectional front elevation view of another embodiment of a beverage container end closure.

Referring now to FIGS. 1-3, cross-sectional front elevation views are provided of alternative embodiments of uncurled beverage can end closures capable of being formed with the process defined herein. Other end closure geometries not shown herein may also be formed using the invention described herein as appreciated by one skilled in the art. More specifically, a metallic beverage can end closure 1 is generally comprised of a circular seaming panel 2, a chuck wall 6, a countersink 7, a central panel 12, and an inner panel radius 11 which interconnects the central panel 12 to the countersink 7. Further, the uncurled seam height 13 may extend beyond the seaming panel 2. The circular seaming panel 2 is additionally comprised of an outer seaming panel radius 3, seaming panel radius 4, and inner seaming panel radius 5. The seaming panel 2 is designed for interconnection to a neck of a container by double seaming or other methods well known in the art. The countersink 7 is generally comprised of an outer countersink panel wall 8, a countersink radius 9, and an inner countersink panel wall 10. In some embodiments, the chuck wall 6 may additionally be comprised of multiple straight angles, radii and arcs depending on any specific application, and as appreciated by one skilled in the art the process described herein is not limited to any specific end closure shape or geometry.

Referring now to FIG. 3, another embodiment of an end closure capable of being formed with the present process is provided herein. In this figure the terms "A" represent a specific angle, "D" a specific diameter, "G" and "H" a specific height, "R" a specific radius and "W" a specific width. As appreciated by one skilled in the art, any of these variables may be modified to provide an end closure specifically suited for a given container, pressure, projected use, etc.

Figure 4:
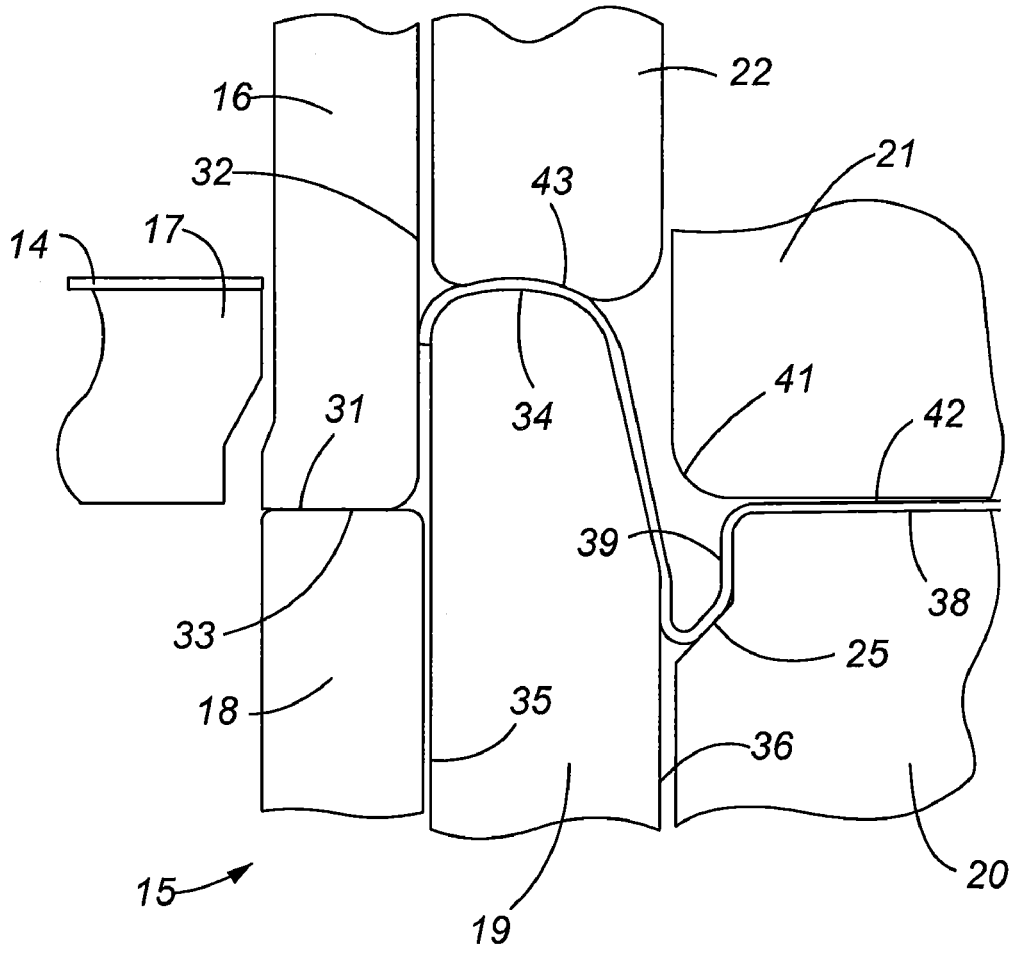
Fig. 4 Prior Art
FIG. 4 is a cross-sectional front elevation view of an end closure being formed in a prior art single action forming press.
Figure 5:
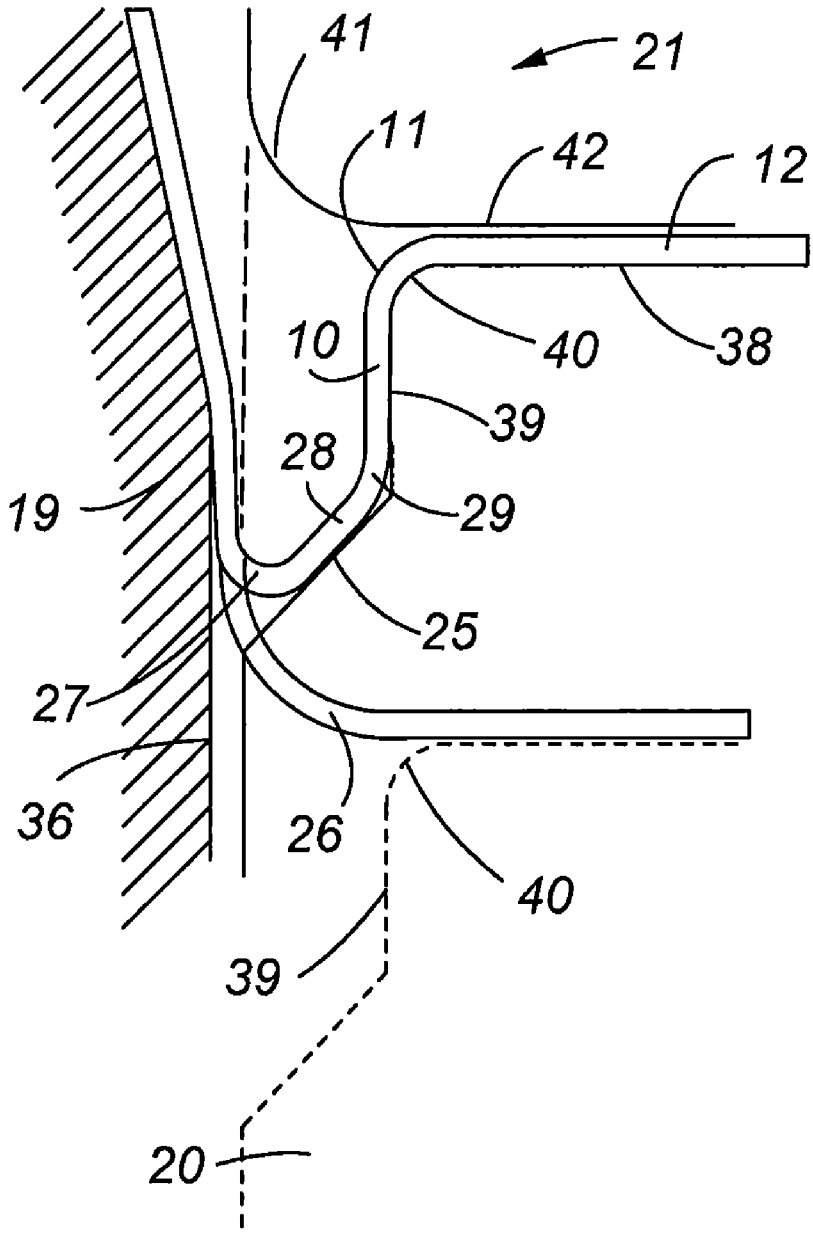
FIG. 5 is a cross-sectional front elevation view of the end closure countersink shown in FIG. 4 as the countersink is being formed.

Referring now to FIGS. 4 and 5, a cross-sectional front elevation view of one embodiment of a prior art single action press for forming a container end closure as shown herein. More specifically, FIG. 5 identifies the cross-sectional front elevational view showing in greater detail the end closure countersink geometry with respect to the forming tool shown in FIG. 4. As shown in FIGS. 4-5, the seaming panel 2 of the uncurled beverage shell 1 is held in position between the die core ring top surface 34 and the knock out or pressure sleeve face 43, while the end closure chuck wall is positioned against the die core ring inner walls 36 The end closure central panel 12 is clamped between the countersink punch 21 and the panel punch 20. FIG. 5 depicts in greater detail the geometry of the end closure 1 which depicts the positioning of the die core ring 19, the panel punch 20 and the die core 21.

Figure 6:
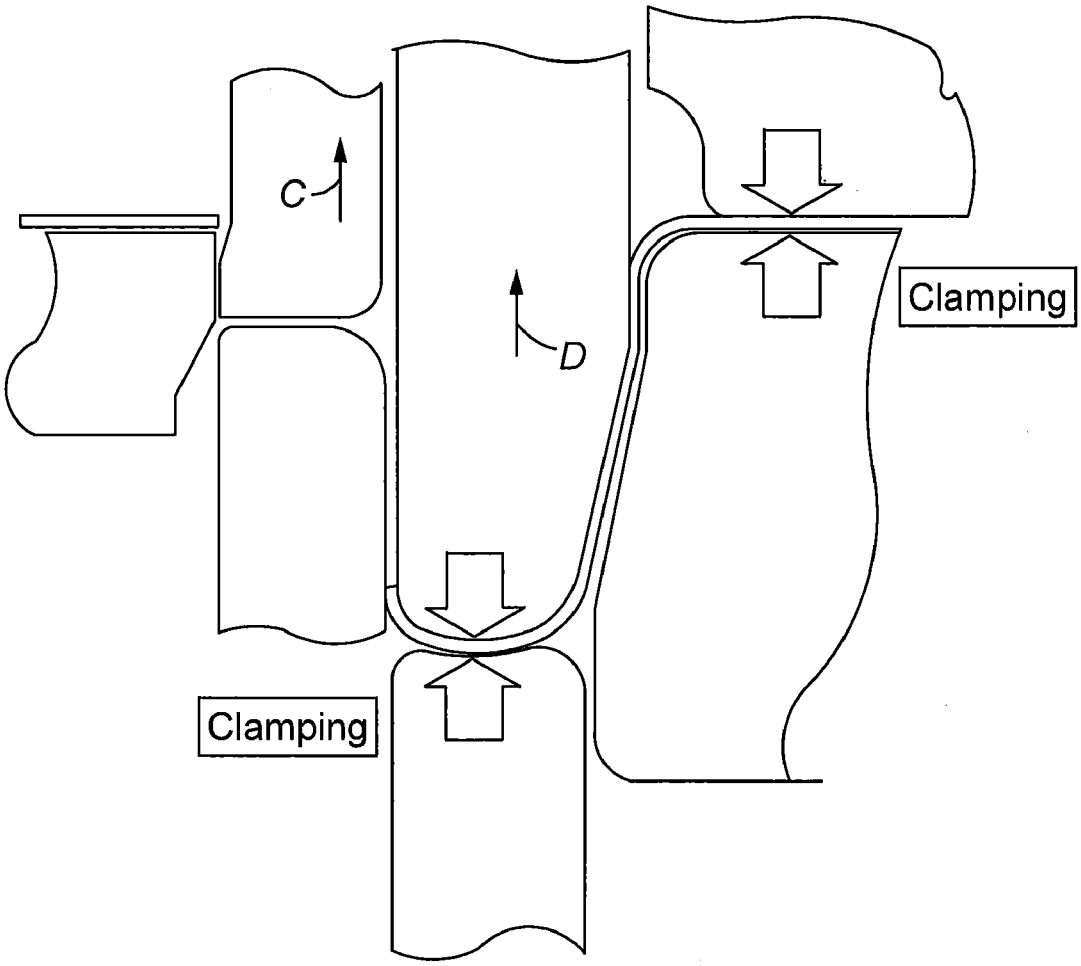
Fig. 6 Prior Art
FIG. 6 is a cross-sectional front elevation view of a prior art apparatus used to form an end closure as disclosed in U.S. Pat. No. 5,685,189.
Figure 7:
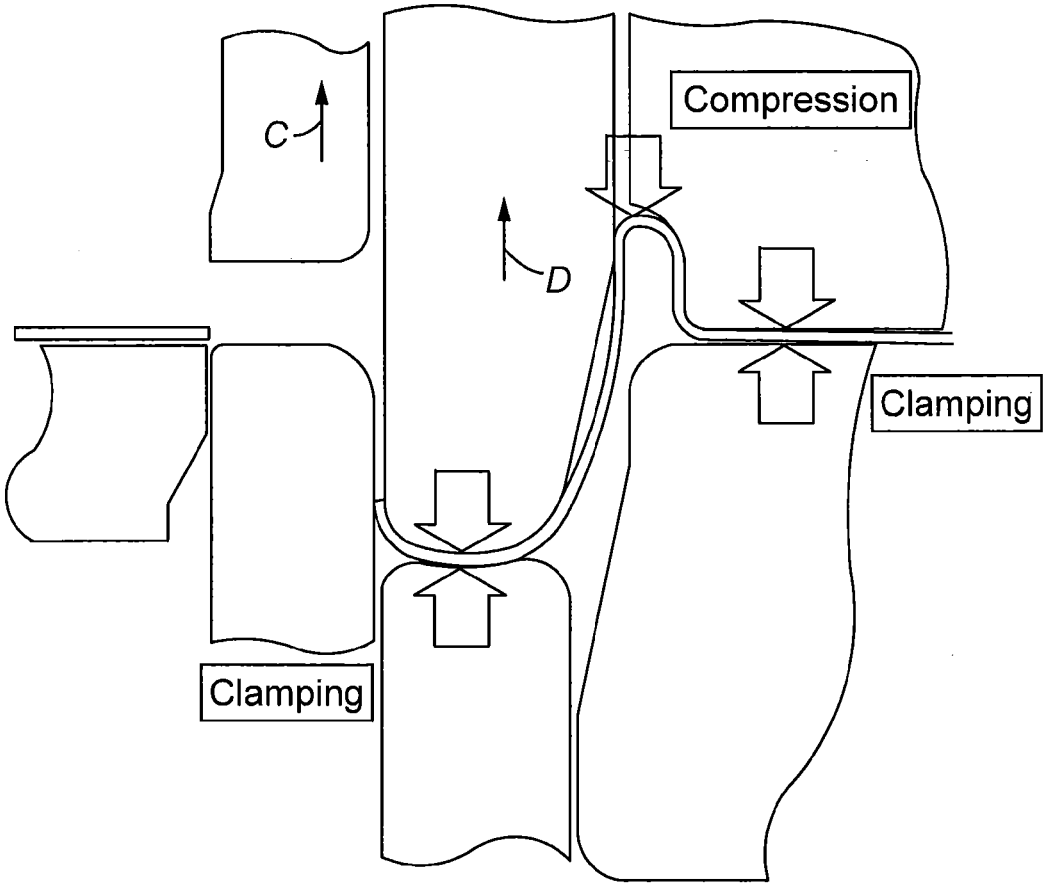
Fig. 7 Prior Art
FIG. 7 is a cross-sectional front elevation view of the prior art apparatus depicted in FIG. 6 and further identifying movement in the chuck wall.

Referring now to FIGS. 6 and 7, a front cross-sectional elevation view of a prior art method of forming an end closure is provided herein, and as described in U.S. Pat. No. 5,685,189 to Nguyen and Farley. More specifically, the positioning of the end closure 1 is identified and more specifically shows where a clamping force is placed on the end closure seaming panel and central panel as depicted by the arrows. More specifically, the numbering related to these drawings in FIGS. 5D and 5E are found in the '189 patent, which is incorporated herein in reference in its entirety.

Figure 8:
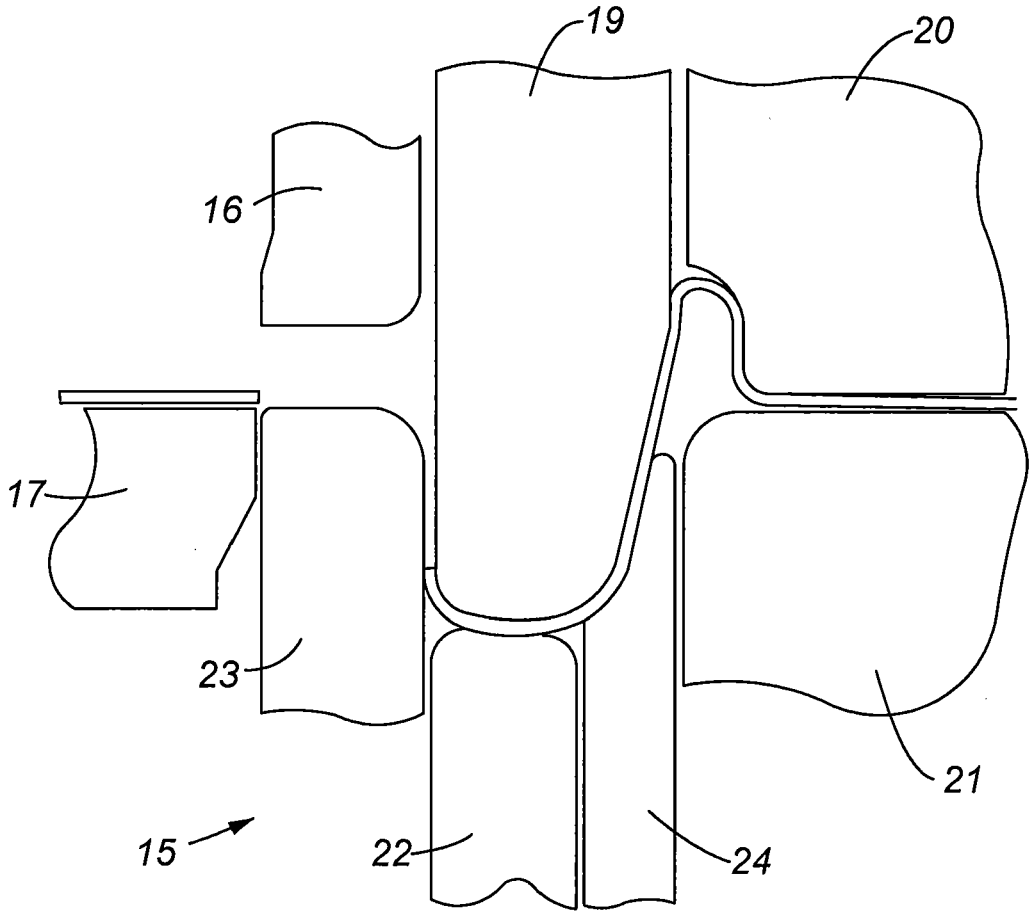
FIG. 8 is a cross-sectional front elevation view of one embodiment of the present invention and identifying an inner pressure sleeve positioned against the chuck wall and the forces acting on the end closure during countersink forming.

Referring now to FIG. 8, a cross-sectional front elevation of one embodiment of the present invention is provided herein, and which further identifies the use of an inner pressure sleeve 24 which is operably positioned opposite the die core ring to hold the end closure chuck wall 6 and seaming panel radius 5 in a preferred position. More specifically, the inner pressure sleeve 24 provides support for the chuck wall 6 and seaming panel radius 5 while the die core ring and outer pressure sleeve 22 move upwardly and the countersink is placed in compression. As further shown in the drawing, the central panel 12 is additionally clamped along with the seaming panel of the uncurled beverage shell 1.

Figure 9:
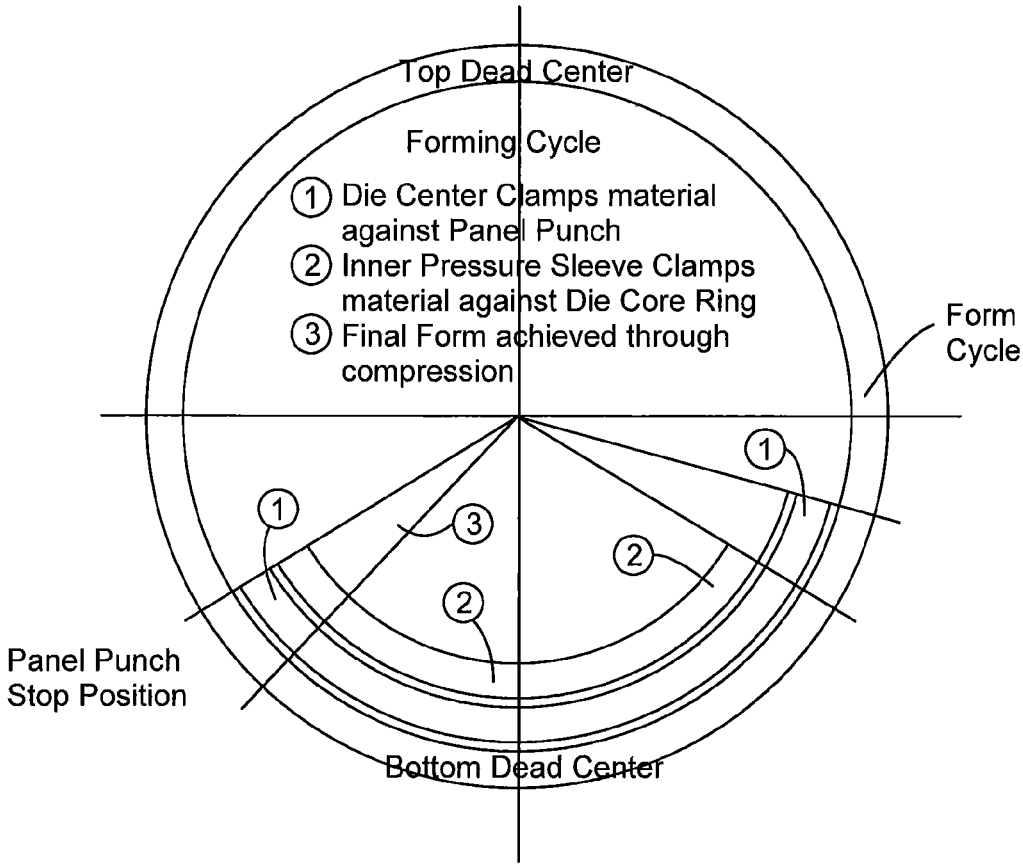
FIG. 9 is a diagram depicting the timing of the inner pressure sleeve and forming cycle as the inner pressure sleeve travels from top dead center to bottom dead center and returning to top dead center.

Referring now to FIG. 9, a depiction of the inner pressure sleeve timing is provided herein, and which shows the operative steps as the pressure sleeve moves from top dead center to bottom dead center returning to top dead center. More specifically, the forming cycle begins when the die center clamps material against the panel punch. The inner pressure sleeve then clamps the material against the die core ring, while the final form is achieved through compression as identified and represented by the number 3.

Figure 10:
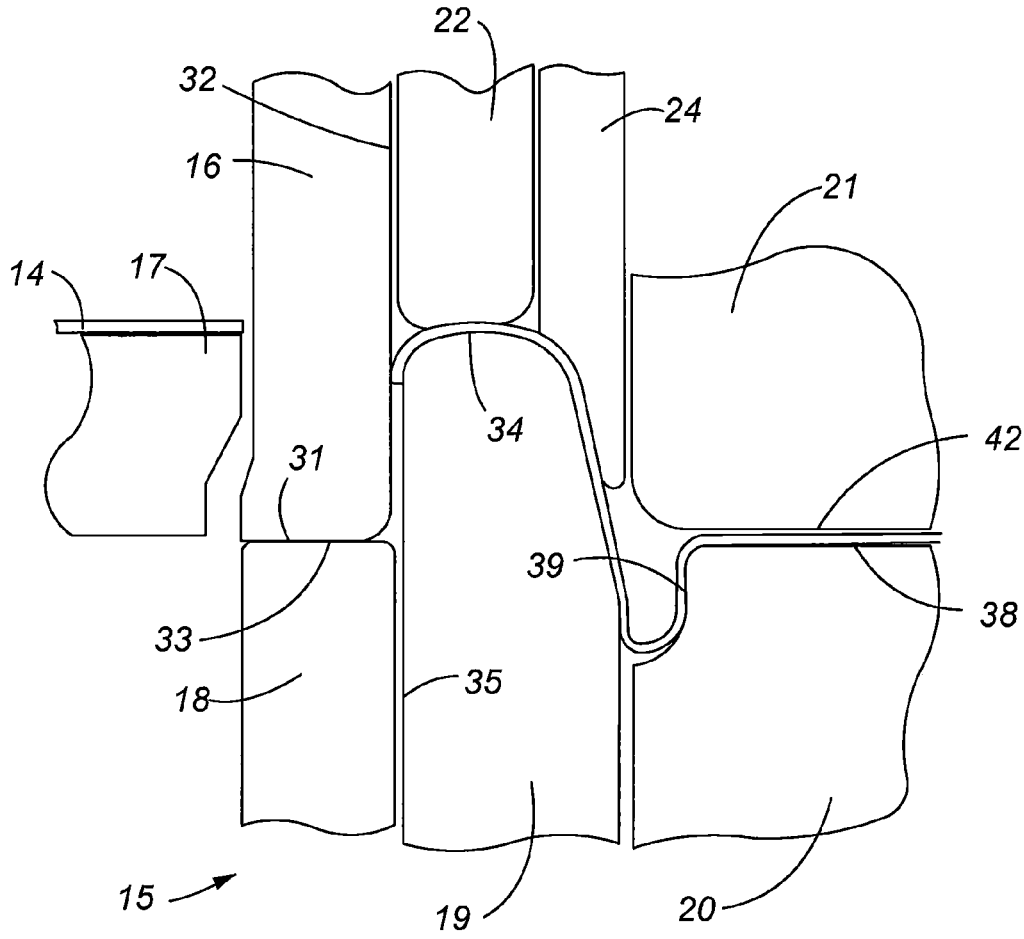
FIG. 10 is a cross-sectional front elevation view of one embodiment of the present invention shown during forming of an end closure and identifying a pressure sleeve providing support to a portion of a chuck wall and inner seaming panel radius.

Referring now to FIG. 10, a cross-sectional front elevation view of one embodiment of the present invention is provided herein, and which shows additional detail regarding the positioning of the various components with respect to the uncurled beverage shell 1, and at the conclusion of the forming process. As further shown in this drawing, the inner pressure sleeve 24 is shown providing support on an exterior surface of the end closure chuck wall and seaming panel radius 5, and retaining the end closure chuck wall securely to the die core ring 19 to prevent any relative movement therein. As compression is provided to the uncurled beverage shell countersink 7, a preferred geometric shape is obtained while retaining the geometry of the chuck wall 6 and seaming panel radius 5 in a preferred orientation.

Figure 11:
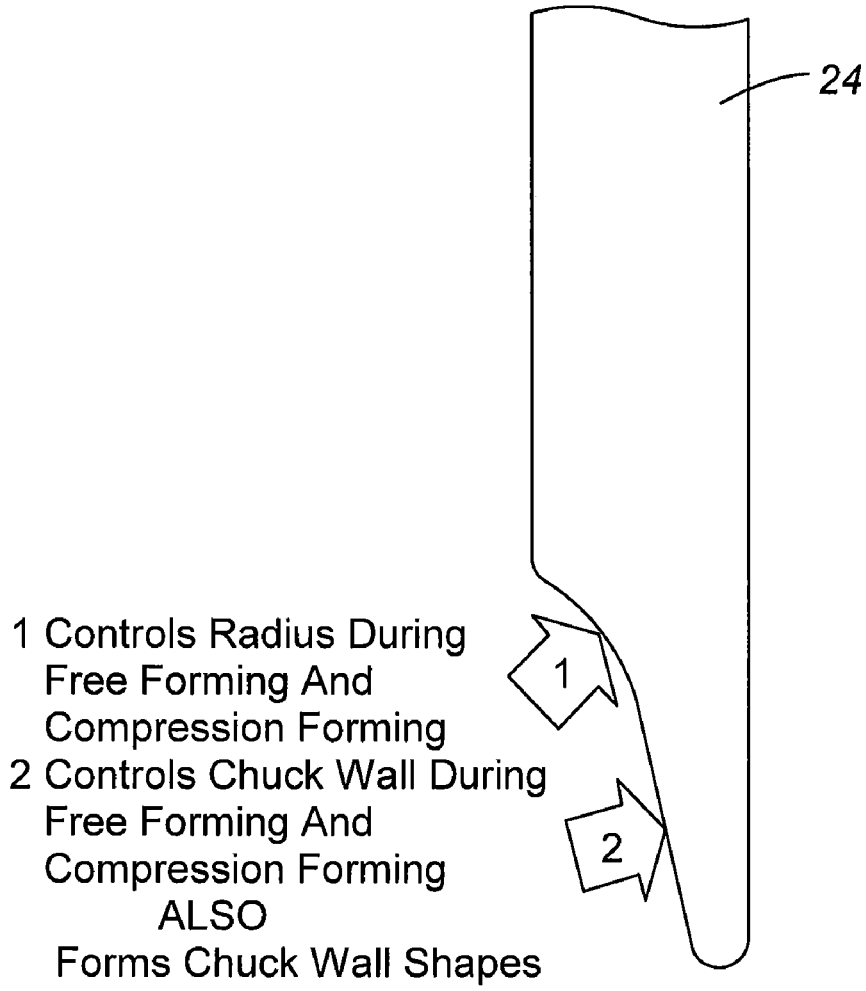
FIG. 11 is a cross-sectional front elevation view depicting one embodiment of an inner pressure sleeve.

Referring now to FIG. 11, a cross-sectional front elevation view of an inner pressure sleeve is provided herein, and which depicts the location of compression on the chuck wall of the uncurled beverage shell 1 to control the chuck wall geometry during the forming process. Furthermore, and as appreciated by one skilled in the art, the geometry of the inner pressure sleeve face will also determine the overall geometry of the chuck wall 6 and seaming panel radius 5 during the forming process.

Referring now to FIGS. 12-23, cross-sectional front elevation views are provided herein which compare the prior art forming process in the right hand portion of the drawing to shape an uncurled beverage shell, as compared to the new free forming method of the present invention shown on the left hand side. As shown in these drawings, the use of an inner pressure sleeve 24 has not previously been used in the art to provide support on the chuck wall and seaming panel radius 5 on the outer surface during the forming process, while simultaneously placing the end closure countersink in compression to allow free forming.

Referring again to FIGS. 10-23, each drawing provides a cross sectional front elevation view intended to identify a tooling assembly with the various components necessary to produce an unseamed beverage container end closure. A complete die may include a single pocket or tooling assembly as illustrated, or multiple pockets, the quantity being limited more so by material width rather than press or tonnage capabilities. The lower tooling components generally include a cut edge 17, a draw ring 18 or die core ring 19, and a panel punch 20. The upper tooling components may include a counter sink punch 21, blanking punch 16, and may include an inner pressure sleeve 24. The die generally operates but is not limited to within a press including a single slide or ram. Beginning in an open position the upper tools are affixed to a die shoe which is attached to a press slide driven by a crankshaft and connection rods tied to a slide. The metallic forming material 14, most commonly aluminum, feeds over the lower tooling, although other well known metals used in the container industry could be utilized.

Figure 12A:
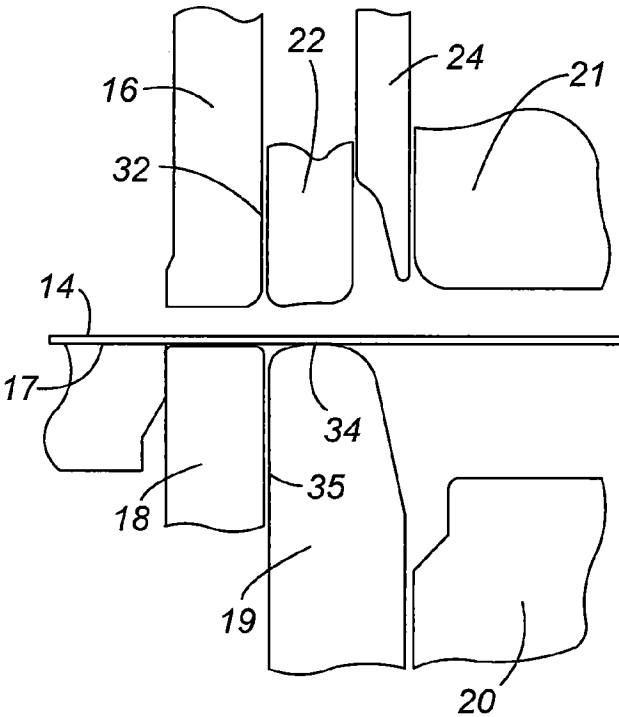
FIG. 12 is a cross-sectional front elevation view comparing the prior art forming apparatus on the right hand portion of the drawing and one new embodiment of the present invention shown on the left hand side of the drawing during the forming process.
Figure 12B:
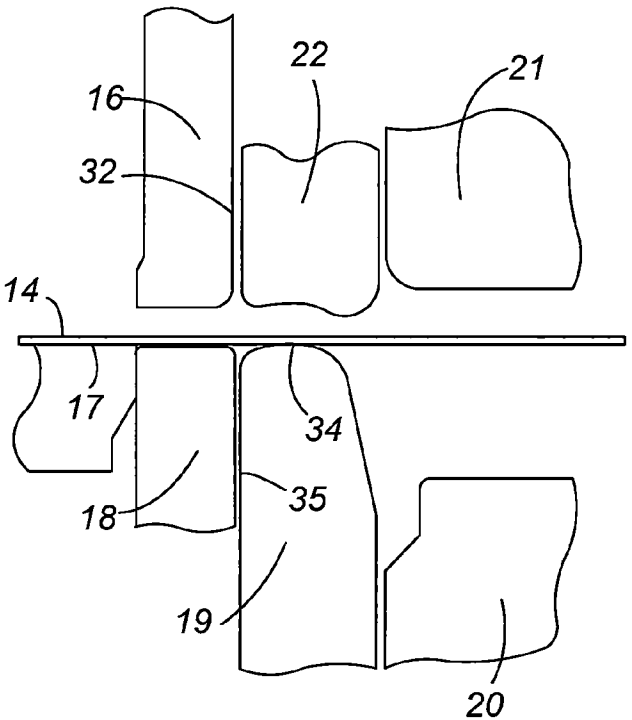
Fig. 12B Prior Art

Referring now to the following figures in greater detail, a brief description of the forming operation is provided herein:

FIG. 12: The upper tooling is shown traveling downward with the blanking punch 16 contacting the material 14, thus initializing a blanking action.

Figure 13A:
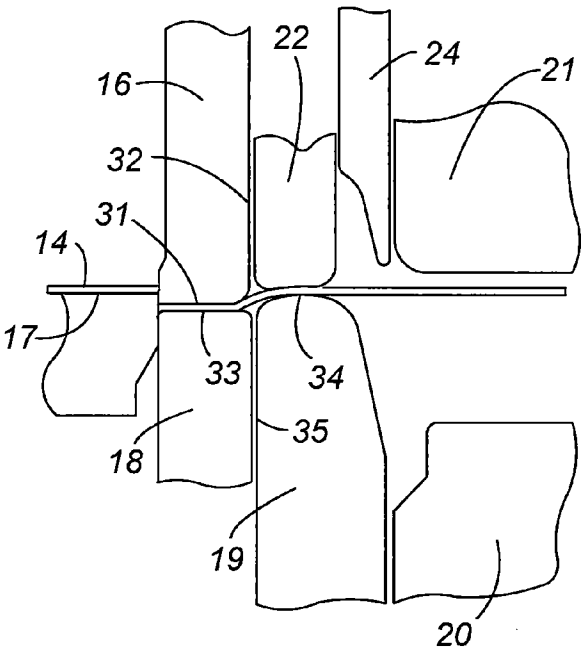
FIG. 13 is a cross-sectional front elevation view comparing the prior art forming apparatus on the right hand portion of the drawing and one new embodiment of the present invention shown on the left hand side of the drawing during the forming process.
Figure 13B:
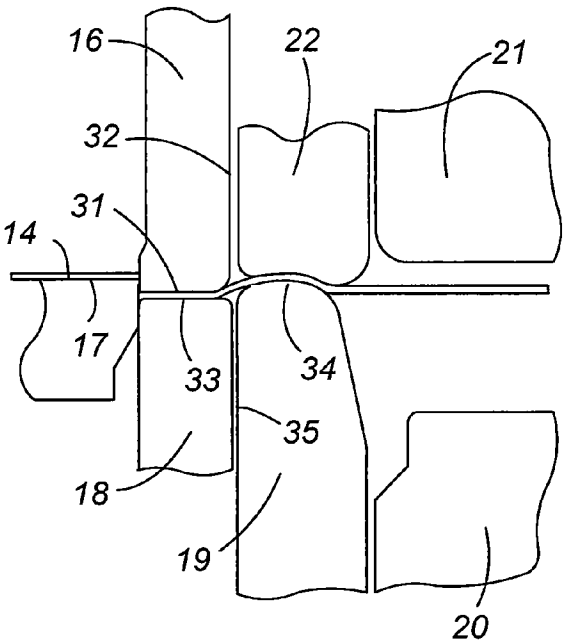
Fig. 13B Prior Art

FIG. 13: The blank metallic material 14 is clamped between blanking punch face 31 and draw ring face 33 at, during or after blanking, with continued downward travel. The clamping force may be a result of a spring, pneumatic application or other similar methods utilized to apply a force. The material is drawn tightly over the top surface of the die core ring 34. With continued downward travel, the metallic material 14 is drawn between the inner most diameter of the blanking punch 32 and the outer most diameter of the die core ring 35. Simultaneously, the metallic material 14 is being clamped between the upper surface of the die core ring 34 and the draw ring 22. The draw ring 22 applies pressure to the metallic material 14 during the forming sequence to control material flow and prevent unwanted distortion. Again, the clamping force may be obtained within a spring, pneumatic application or other similar methods utilized to apply a force.

Figure 14A:
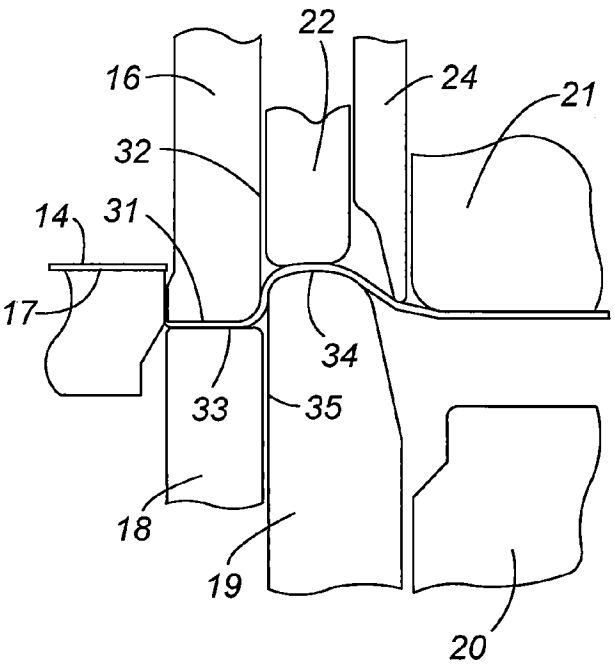
FIG. 14 is a cross-sectional front elevation view comparing the prior art forming apparatus on the right hand portion of the drawing and one new embodiment of the present invention shown on the left hand side of the drawing during the forming process.
Figure 14B:
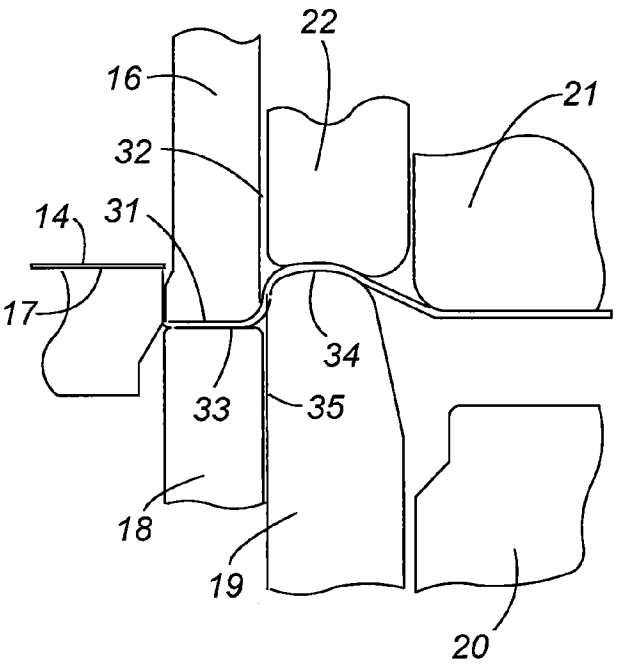
Fig. 14B Prior Art
Figure 15B:
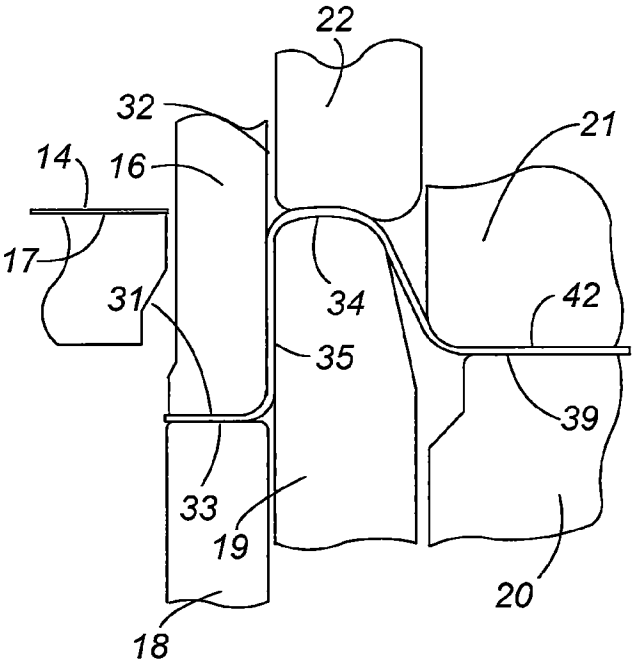
Fig. 15B Prior Art
FIG. 15 is a cross-sectional front elevation view comparing the prior art forming apparatus on the right hand portion of the drawing and one new embodiment of the present invention shown on the left hand side of the drawing during the forming process.
Figure 15A:
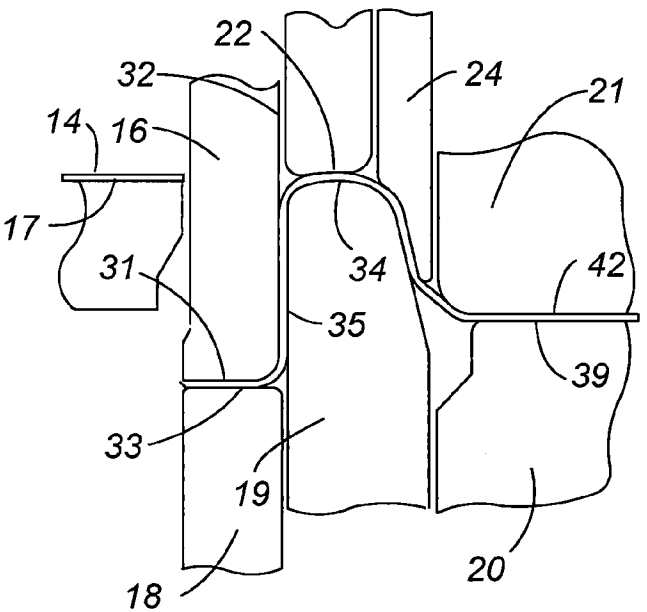

FIG. 14-15: With continued downward travel, the die core 21 comes in contact with the material and begins the drawing process of the metallic material 14 to begin forming the interior geometry of the beverage can end. During the downward travel, the metallic material 14 becomes clamped between the die core 21 and the panel punch 20, and the die core ring 19 and inner pressure sleeve 24.

Figure 16A:
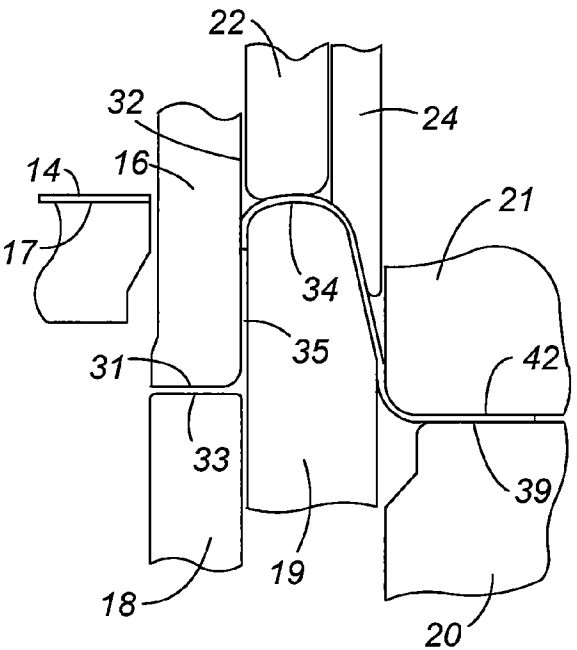
FIG. 16 is a cross-sectional front elevation view comparing the prior art forming apparatus on the right hand portion of the drawing and one new embodiment of the present invention shown on the left hand side of the drawing during the forming process.
Figure 16B:
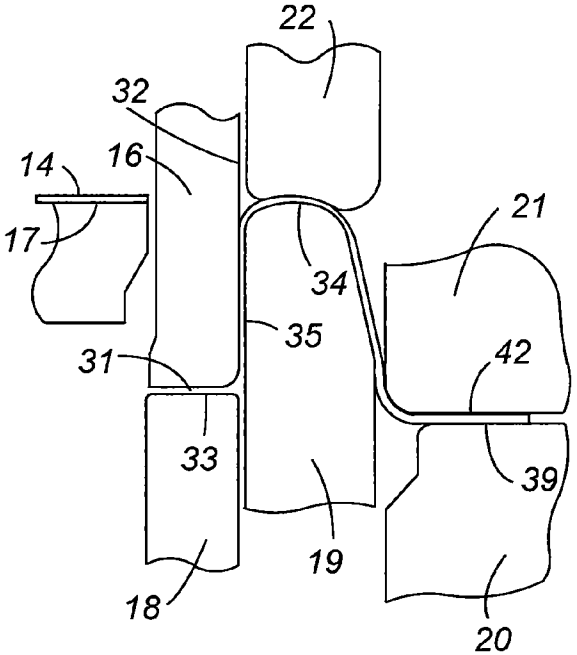
Fig. 16B Prior Art

FIG. 16: With continued downward travel, the forming sequence reaches the final downward movement, known as bottom dead center. At this stage of the sequence, the seaming panel 2 and chuckwall 6 have substantially been formed. In addition, the metallic material 14 available to form the final countersink geometry 7 and the center panel geometry 12 has been drawn to the interior diameter of the die core ring 19 between surfaces 36 and 39.

Figure 17A:
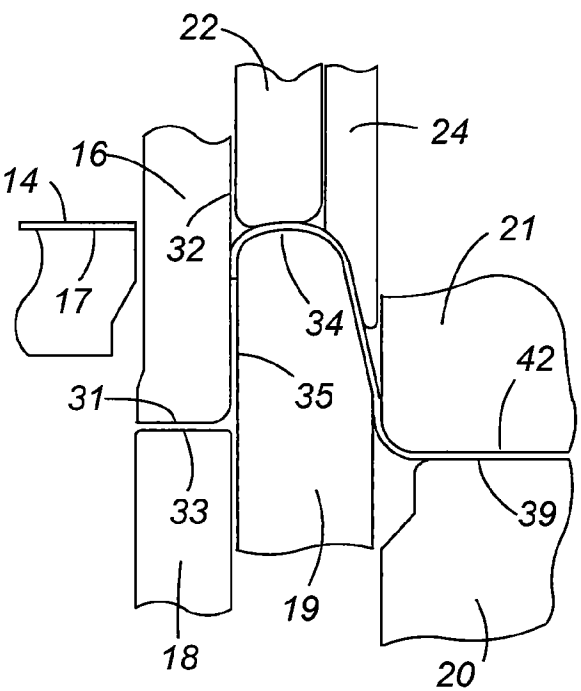
FIG. 17 is a cross-sectional front elevation view comparing the prior art forming apparatus on the right hand portion of the drawing and one new embodiment of the present invention shown on the left hand side of the drawing during the forming process.
Figure 17B:
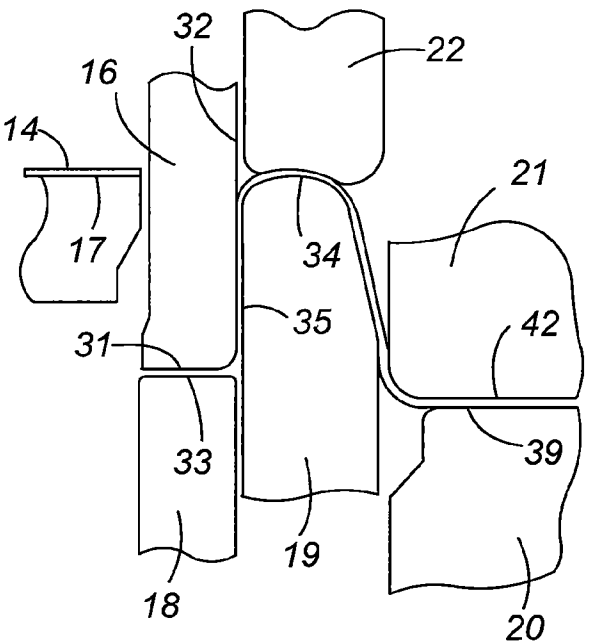
Figures 18A, 18B:
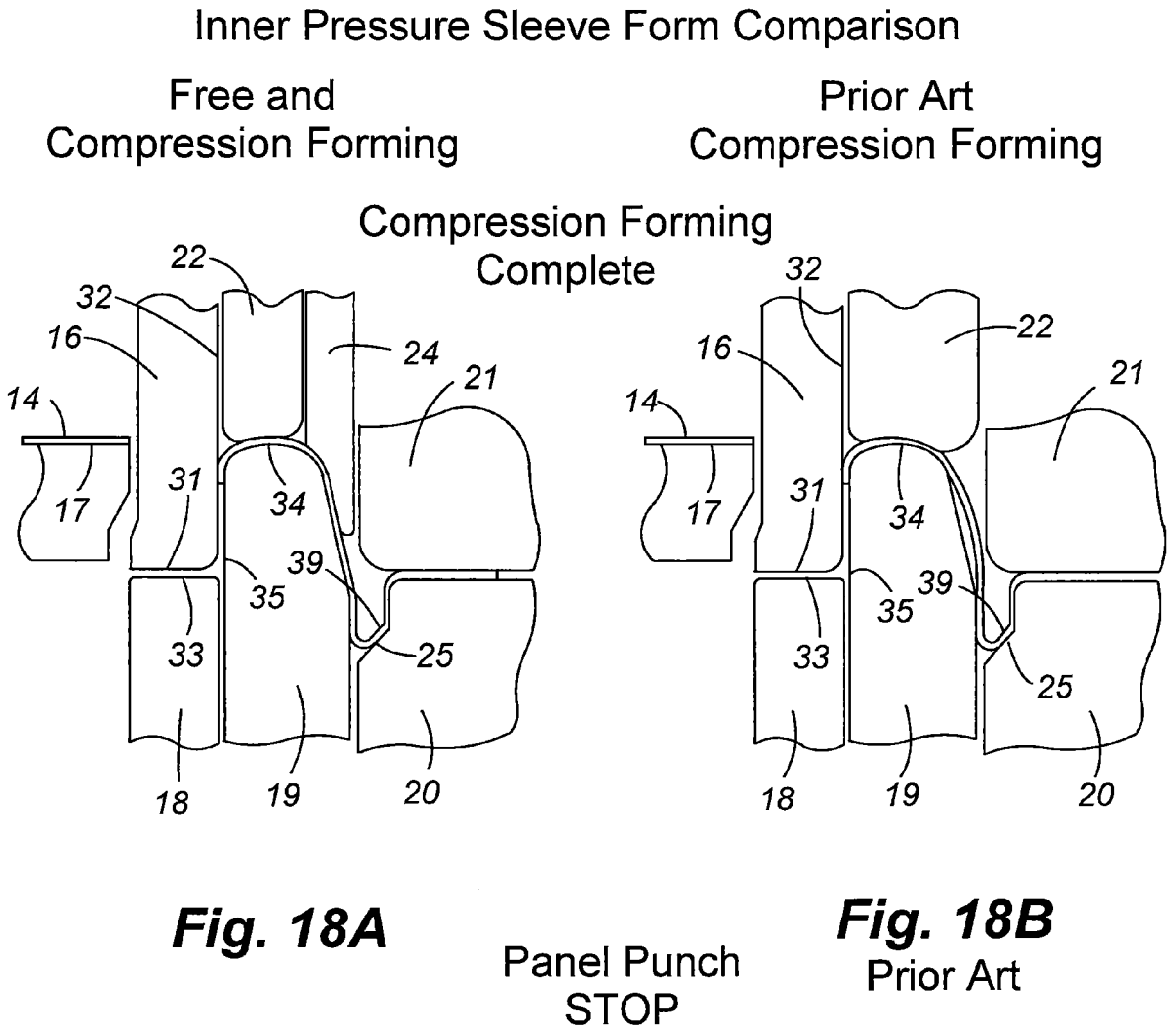
Fig. 18B Prior Art
FIG. 18 is a cross-sectional front elevation view comparing the prior art forming apparatus on the right hand portion of the drawing and one new embodiment of the present invention shown on the left hand side of the drawing during the forming process.
Figure 19B:
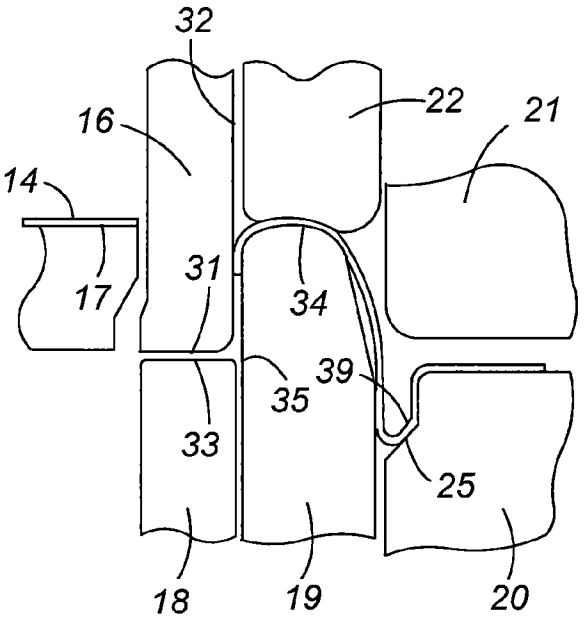
Fig. 19B Prior Art
FIG. 19 is a cross-sectional front elevation view comparing the prior art forming apparatus on the right hand portion of the drawing and one new embodiment of the present invention shown on the left hand side of the drawing during the forming process.
Figure 19A:
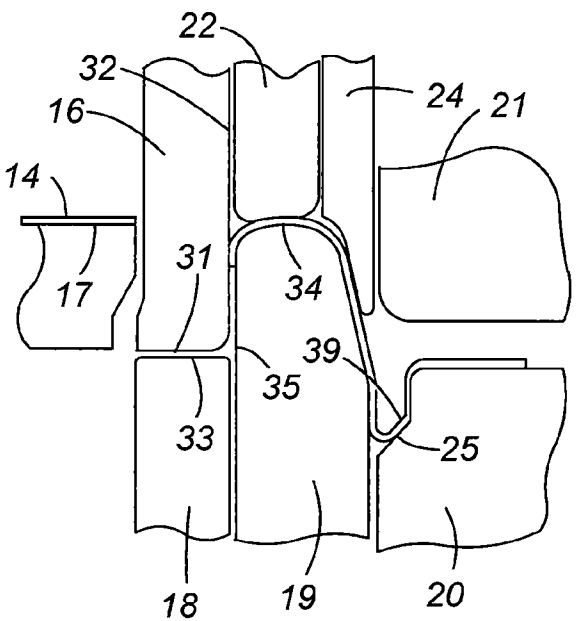
Figure 20A:
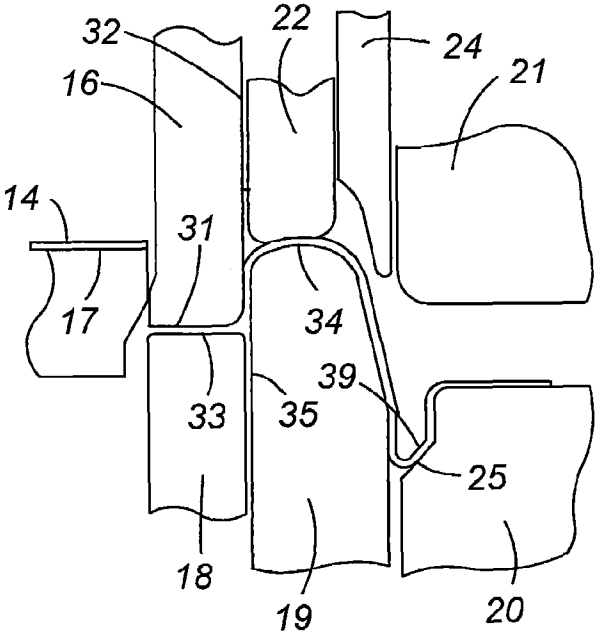
FIG. 20 is a cross-sectional front elevation view comparing the prior art forming apparatus on the right hand portion of the drawing and one new embodiment of the present invention shown on the left hand side of the drawing during the forming process.
Figure 20B:
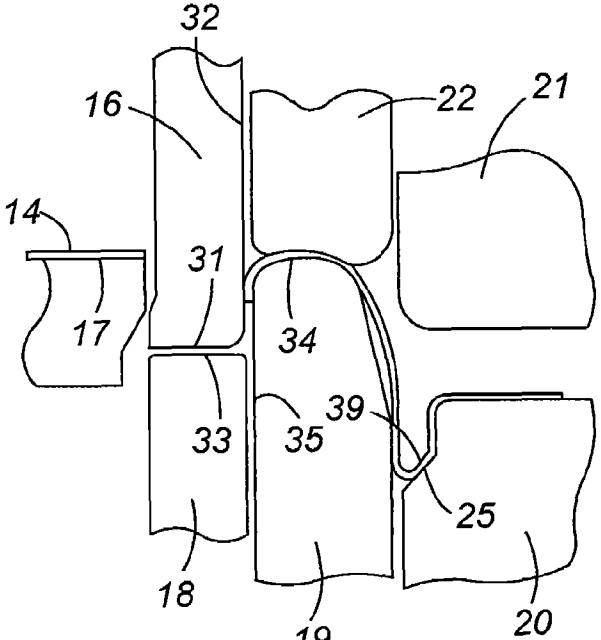
Fig. 20B Prior Art
Figure 21A:
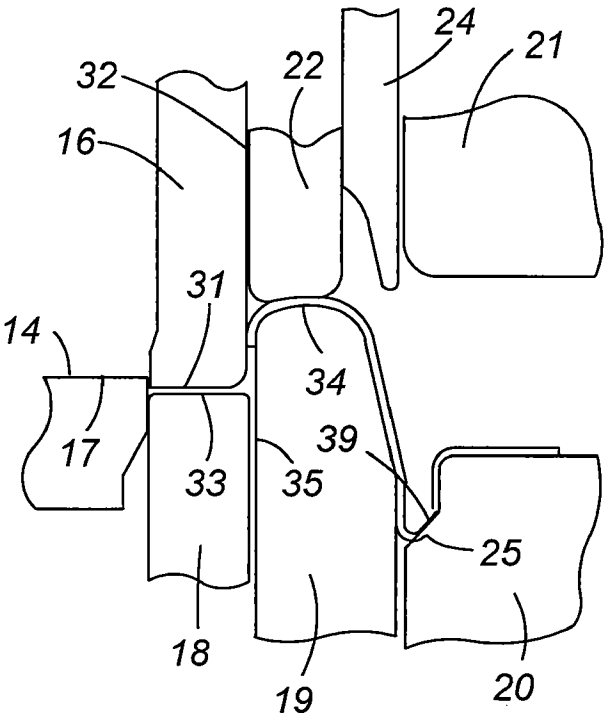
FIG. 21 is a cross-sectional front elevation view comparing the prior art forming apparatus on the right hand portion of the drawing and one new embodiment of the present invention shown on the left hand side of the drawing during the forming process.
Figure 21B:
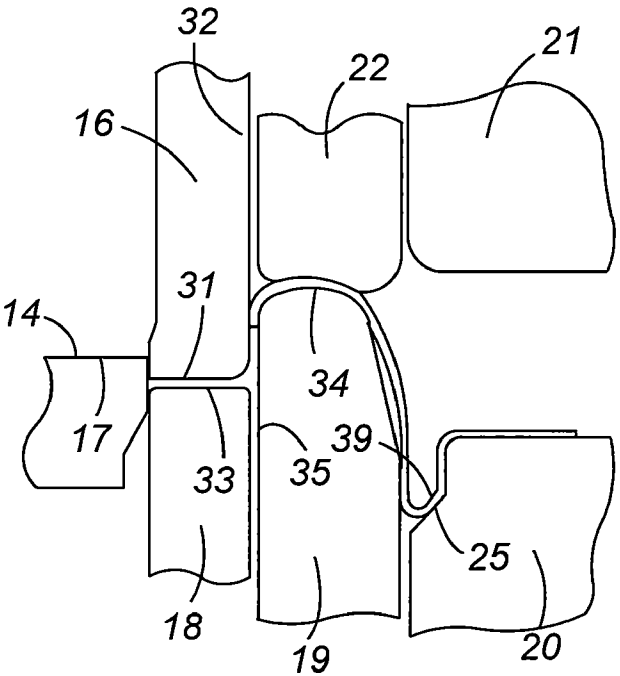
Fig. 21B Prior Art
Figure 22A:
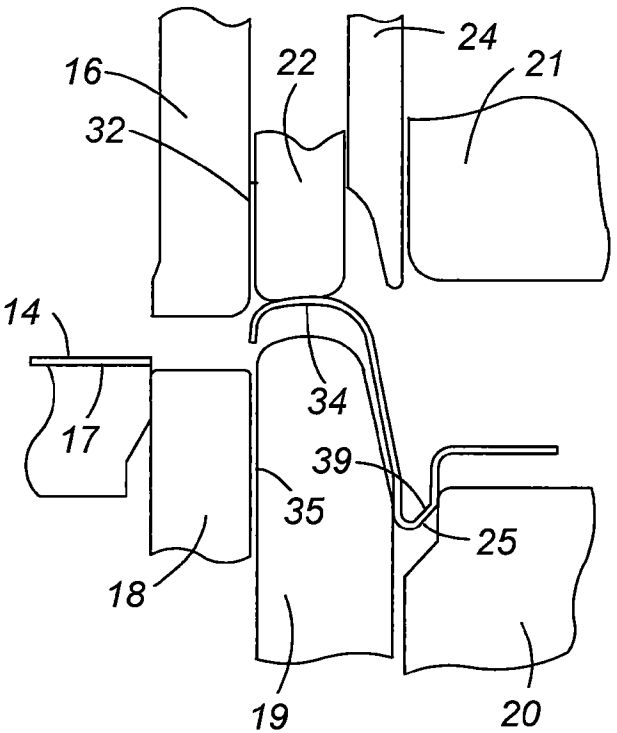
FIG. 22 is a cross-sectional front elevation view comparing the prior art forming apparatus on the right hand portion of the drawing and one new embodiment of the present invention shown on the left hand side of the drawing during the forming process.
Figure 22B:
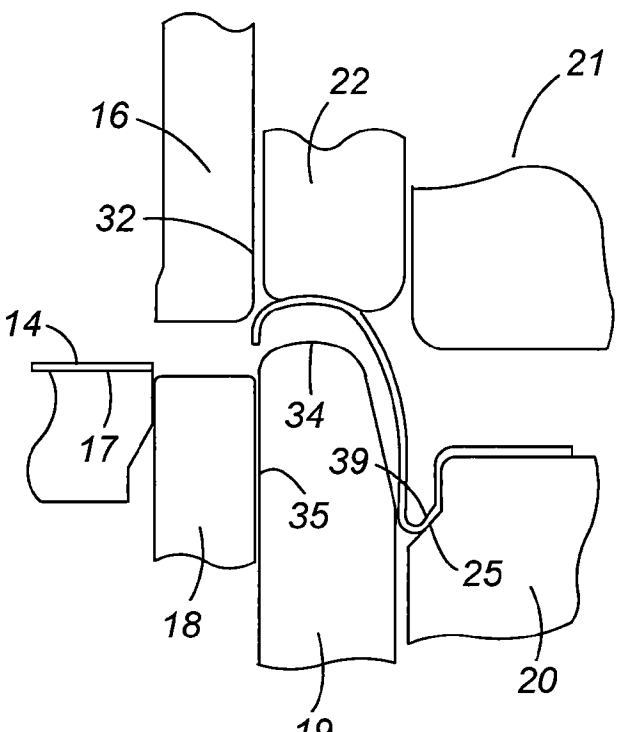
Figure 23A:
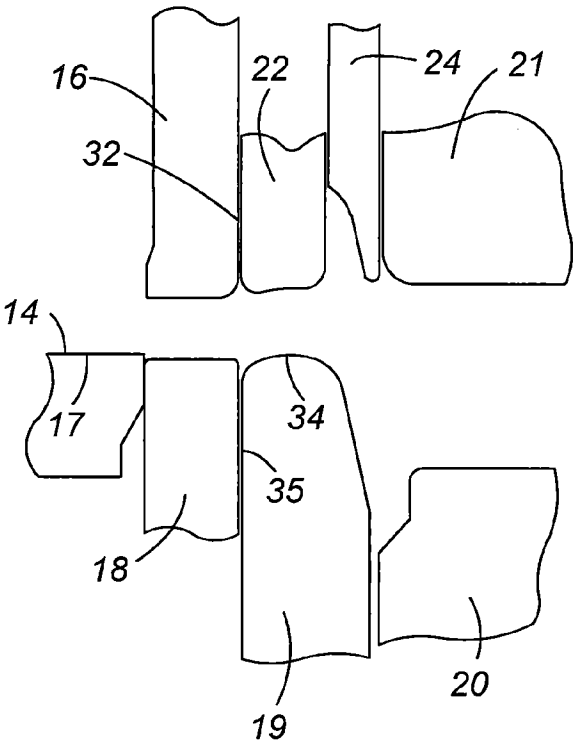
FIG. 23 is a cross-sectional front elevation view comparing the prior art forming apparatus on the right hand portion of the drawing and one new embodiment of the present invention shown on the left hand side of the drawing during the forming process.
Figure 23B:
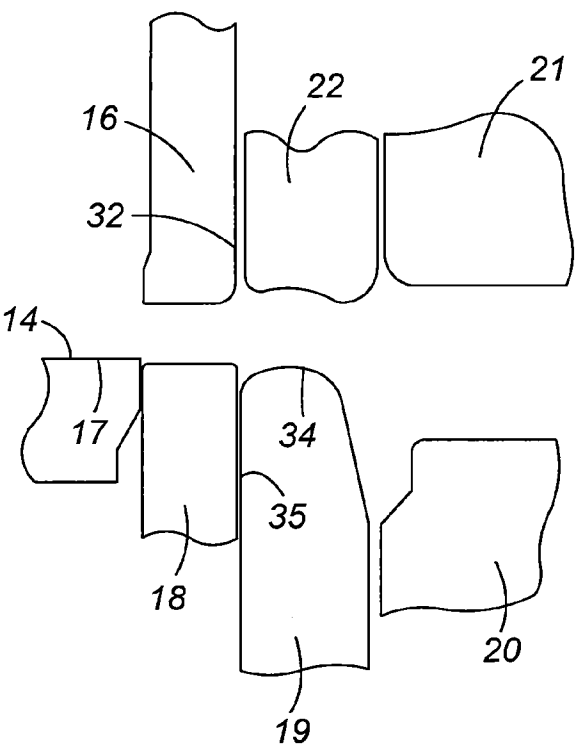

FIG. 17-18: The forming sequence is shown continuing with upward travel of the blanking punch 16, die core 21, and the panel punch 20. The sequence continues upward until the panel punch 20 returns to its original position, or also referred to as stop position free forming and compressing the final countersink geometry 7 with the inner pressure sleeve 24 continuing to clamp on the die core ring 19 up to or beyond the stop position. At this stage of the sequence, the uncurled beverage end formation is complete, however removal of the completed container beverage end must be accomplished.

FIG. 19-23: The forming sequence continues upward until the full open position is achieved. The outer pressure sleeve 22 serves to strip the now finished yet uncurled container end from the innermost diameter 32 of the blanking punch 16 and the shell is ejected by air or other similar method.

Referring again to FIGS. 12-23, a comparison of the prior art method of forming an end closure is shown on the right hand side, while the new forming technique is shown on the left. As depicted in this sequence of drawings, the new forming process provides distinct advantages, including:

a) capable of producing end closures with aggressive geometries while maintaining total control of the chuck wall and seaming panel;

b) allows the forming of difficult chuck wall and countersink geometries without metal thickness reductions;

c) allows the formation of end closure countersinks with material thickening, wherein the prior art may create thinning or coining in the metal in various locations;

d) the added control of the present invention allows tooling designs which more accurately define closure contours than previous apparatus with aggressive forms;

e) capable of producing closure with higher strength materials without the metal fatigue normally associated with tight forms and radii;

f) the greater control and latitude provided by the present invention allow higher strength end closures with lower material gauge; and g) improved operating efficiency during manufacturing and removal of the container end closures from the forming press.

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. A method for forming a predetermined shape in a metallic container end closure adapted for interconnection to a neck of a container, comprising:

positioning a metallic end closure blank in a forming press;

providing a clamping force on at least a portion of a seaming panel between a first tool and a second tool, said at least a portion of a seaming panel being oriented in a first substantially horizontal direction;

providing a clamping force on at least a portion of a central panel between a third tool and a fourth tool to substantially prevent movement of the central panel;

while the clamping force is provided on the at least a portion of the central panel, supporting at least a portion of a chuck wall and an inner seaming panel radius on both an interior surface and an exterior surface to substantially prevent movement of at least a portion of the chuck wall and inner seaming panel radius, wherein said inner seaming panel radius is supported along its cross-sectional radius of curvature that begins proximate to a first point of divergence from said first substantially horizontal direction of said seaming panel;

supporting a first portion of the countersink with at least one of said third tool and said fourth tool while an exterior portion of the countersink is unsupported with any tools; and providing a compressive force on a lower portion of the countersink while retaining the chuck wall in a preferred position, wherein the end closure is formed into a predetermined shape.

2. The method of claim 1, wherein the end closure countersink material retains substantially the same thickness during the forming of the end closure.

3. The method of claim 1, wherein the unsupported portion of the countersink changes shape during the forming process.

4. The method of claim 1, wherein said first tool comprises an outer pressure sleeve and said second tool comprises a die core ring.

5. The method of claim 1, wherein the chuck wall is supported on the interior surface with a die core ring and on an exterior surface with an inner pressure sleeve.

6. The method of claim 2, wherein the third tool comprises a countersink punch and said fourth tool comprises a panel punch.

7. The method of claim 4, wherein the countersink is placed in compression as an inner pressure sleeve travels from a position of top dead center to bottom dead center.

8. The method of claim 1, wherein the end closure chuck wall is supported on an exterior surface by a pressure sleeve.

9. The method of claim 8, wherein the pressure sleeve may have a distinct geometry to define a chuck wall shape during the forming process.

10. The method of claim 1, wherein providing a clamping force on a portion of the seaming panel provides compression between said first tool and said second tool.

11. An apparatus for forming a preferred shape in a metallic material to create a beverage end closure adapted for interconnection to a container, comprising:

a first tool in opposing relationship to a second tool which is adapted to provide a clamping force on a portion of a seaming panel of the metallic material;

a third tool in opposing relationship to a fourth tool which is adapted to providing a clamping force on a central panel portion of the metallic material, said fourth tool further supporting a lower portion of an interior surface of the countersink to apply a compressive force on the countersink;

a fifth tool positioned between said first tool and said third tool, which is adapted to support at least a portion of a chuck wall portion of said metallic material, without contacting an exterior surface of the countersink, wherein said fifth tool is further adapted to support a curving transition between said chuck wall and said seaming panel, wherein said curving transition begins at a location where the seaming panel begins diverging downward from a substantially horizontal plane; and providing a reciprocating motion between at least said fifth tool and said first and second tools while a portion of a countersink in the container end closure remains unsupported on an exterior surface while supported on an interior surface, wherein a preferred geometry is created in the countersink as a compressive force is applied thereto, thus substantially avoiding a reduction of material thickness of the countersink.

12. The apparatus of claim 11, wherein said first tool comprises an outer pressure sleeve.

13. The apparatus of claim 11, wherein said second tool comprises a die core ring.

14. The apparatus of claim 11, wherein said third tool comprises a countersink punch.

15. The apparatus of claim 11, wherein said fourth tool comprises a panel punch.

16. The apparatus of claim 11, wherein said fifth tool comprises an inner pressure sleeve.

17. The apparatus of claim 11, further comprising a blank punch and draw ring which arc adapted to retain a portion of metallic material during manufacturing and which are positioned adjacent to the first and second tools.

18. A method for forming a metallic end closure adapted for interconnection to a neck of a container, comprising:

a first clamping means for holding a first portion of a metallic material;

a second clamping means for holding a second portion of the metallic material and comprising a tool with a geometric profile adapted to support a lower interior surface of the metallic material, said second portion of the metallic material positioned interior to said first portion;

an inner pressure sleeve having an upper end and a lower end, said lower end positioned between said first clamping means and said second clamping means, and comprising an engagement surface having at least one radius of curvature inwardly directed toward said metallic material and in operable engagement with said metallic material and said lower end positioned above the metallic material held by said second clamping means, wherein a void is located between said first clamping means, said second clamping means and said pressure sleeve, and wherein said metallic material that is in operable engagement with said engagement surface of said inner pressure sleeve comprises a radius that substantially begins at a point where said metallic material diverges downward from a substantially horizontal plane;

wherein at least a portion of said first clamping means and said second clamping means travels with respect to said pressure sleeve, wherein a preferred metal geometry is formed in compression within said void while a portion of said metallic material is retained between said pressure sleeve and said first clamping means.

19. The method of claim 18, wherein said first clamping means comprises an outer pressure sleeve in opposing relationship to a die core ring.

20. The method of claim 18, wherein said second clamping means comprises a countersink punch positioned opposite to a panel punch.

21. The method of claim 18, wherein said preferred metal geometry in said void comprises a countersink in the metallic end closure.

22. The method of claim 19, further comprising a blank punch and draw ring positioned adjacent said outer pressure sleeve and die core ring, respectively which are adapted to clamp a portion of said metallic material.

23. The method of claim 1, further comprising supporting at least a portion of a seaming panel radius on both an interior surface and an exterior surface in addition to supporting the inner seaming panel radius.

24. The method of claim 23, wherein the at least a portion of the seaming panel radius and the inner seaming panel radius are supported by a common tool.

25. The method of claim 24, wherein the common tool comprises an inner pressure sleeve.

26. The apparatus of claim 11, wherein said curving transition comprises a portion of at least one of a seaming panel radius and an inner seaming panel radius.

* * * * *